United States Patent [19]

Baran et al.

[11] 4,404,445

[45] Sep. 13, 1983

[54] PUSHBUTTON SWITCH OPERATOR ASSEMBLY

[75] Inventors: Michael S. Baran, St. Francis; Arthur J. Felber, Muskego; Gary C. Fillus, South Milwaukee, all of Wis.

[73] Assignee: Allen-Bradley Company, Milwaukee, Wis.

[21] Appl. No.: 403,595

[22] Filed: Jul. 30, 1982

[51] Int. Cl.[3] ..... H01H 9/16; H01H 13/62

[52] U.S. Cl. ..... 200/314; 200/328

[58] Field of Search ..... 200/321, 322, 323, 324, 200/325, 328, 159 R, 340, 153 L

[56] References Cited

U.S. PATENT DOCUMENTS

| | | | |
|---|---|---|---|
| 626,919 | 6/1899 | Medary | 200/159 R |
| 1,352,889 | 9/1920 | Gallo et al. | 200/160 |
| 1,889,175 | 11/1932 | Evans | 200/340 |
| 2,523,125 | 9/1950 | Ley | 200/61.79 |
| 2,671,354 | 3/1954 | Goos | 74/503 |
| 2,996,593 | 8/1961 | McMains | 200/159 |
| 3,040,142 | 6/1962 | Dietrich et al. | 200/159 R |
| 3,984,797 | 10/1976 | Rayburn | 200/314 |
| 4,182,943 | 1/1980 | Butterworth | 200/159 R |
| 4,233,479 | 11/1980 | Karpe et al. | 200/77 |
| 4,314,124 | 2/1982 | Sauer et al. | 200/328 |
| 4,315,123 | 2/1982 | Fujita et al. | 200/314 |

FOREIGN PATENT DOCUMENTS

| | | |
|---|---|---|
| 288944 | 4/1967 | Australia . |
| 2263762 | 7/1974 | Fed. Rep. of Germany . |

*Primary Examiner*—John W. Shepperd

*Attorney, Agent, or Firm*—Arnold J. Ericsen

[57] ABSTRACT

A pushbutton switch operator assembly including concentrically arrayed tubular members permitting dual action of an actuator to release switch contacts from a first maintained position to a second maintained position either by a rotative manual operation of a tubular actuator or by manual axial "push-pull" actuator operation. This dual action is provided by longitudinal movement of a switching member having a cam profile acting against spring bias of a detent member, and wherein this longitudinal movement is obtained by said manual "push-pull" operation or by a camming action provided by mating ramp surfaces during rotation of the actuator with respect to a stationary supporting member.

8 Claims, 7 Drawing Figures

PUSHBUTTON SWITCH OPERATOR ASSEMBLY

FIELD OF THE INVENTION

This invention relates to a pushbutton device for controlling electrical apparatus.

BACKGROUND OF THE INVENTION

"Push-pull" pushbutton switch operators are well-known in the art. It appears, however, that in the case of so-called, "emergency stop" buttons, certain regional practices have demanded rotational, or "twist-to-release", operation of the mushroon head operator to release the button after stop operation, in contrast to the conventional practice of providing a maintained contact, "push-pull" operation. That is, conventional pushbutton switch contacts are operated from their normal operating position by manually pushing a mushroom head operator inwardly in an axial direction. The contacts are maintained in such position by means of detent members acting against cam surfaces, or other means, and are released from that maintained position by an outwardly directed axial manual pull of the operator. In certain regions of the world, machine tool operating personnel use pushbuttons that are pushed inwardly to operate the contacts from a normal position, but are twisted or rotated to release the actuator and thereby return the contacts to the normal position.

In such devices, the usual biasing springs and cooperating mechanism required to provide torsional resistance have heretofore prevented installation of signal lamps which provide the operator with the usual visual indication of switch operation.

SUMMARY OF THE INVENTION

The present invention provides a pushbutton switch operator assembly, including a supporting base having a cavity which contains spring-biased detent means engageable with a cam profile defined on a side surface of an axially movable switching member. The switching member has a portion extending outwardly of the base for operational engagement of switch contacts on a cooperating contact module. The detent means and cooperating cam profile maintain the switching member in either a first or a second switch operating position. There is also provided a tubular actuator operated by the operator, and adapted for alternative axial and rotatable movement relative to an integrally formed tubular post extending inwardly of the supporting base. This actuator contains a groove for slidably receiving the switching member. Further, there is provided cam means between the base and the actuator to provide axial movement in a direction away from the base upon manual rotation of the actuator, and against the spring bias of a torsion spring, whereby the actuator may be manually moved axially either upon rotative operation under the action of the cam means, or alternatively, by a manual pulling action on the actuator to thereby alternatively cause the switch member to move axially in opposition to the action of the spring-biased detent member.

The particular embodiment described herein has adaptation for use in connection with contact modules such as those disclosed and claimed in U.S. Pat. No. 3,514,554 issued to Gerd C. Boysen on May 26, 1970, and assigned to the same assignee as the present invention.

The switch operator assembly of this invention comprises a series of cooperating, concentric, tubular members, the innermost supporting post projecting from a base member also arranged to receive a removable lamp and socket subassembly. A pushbutton operator is preferably of the "mushroom" type of a clear or colored translucent plastic material to provide illumination from the lamp. The terminals of the lamp socket are arranged for electrical connection with a transformer module, or for direct connection with circuit voltage, as desired.

DESCRIPTION OF THE PREFERRED EMBODIMENT

Figure 1:
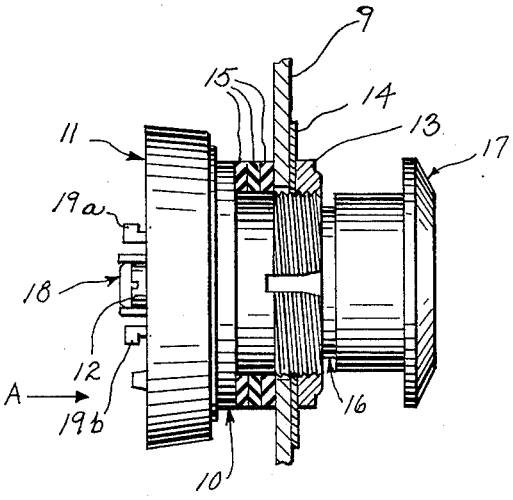
FIG. 1 is a side elevational view of the switch operator assembly of this invention, and further disclosed in mounting position relative to a supporting panel.
Figure 2:
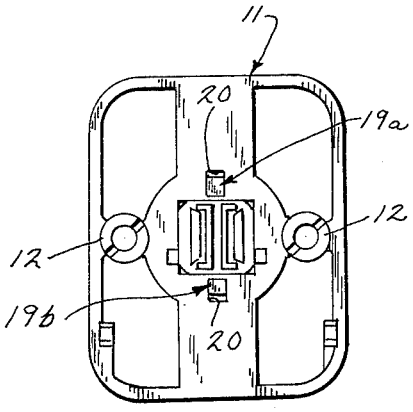
FIG. 2 is a rear view of the assembly, taken in the direction of the arrow A in FIG. 1.

Referring to FIGS. 1 and 2, there is shown a pushbutton switch operator assembly mounted on a panel 9, but with the switch contact module or modules or a transformer module, when required, omitted from the drawing. As stated previously, these modules are illustrated and fully described in the Boysen U.S. Pat. No. 3,514,554. The assembly comprises a threaded hollow bushing 10 attached to an insulating base member 11 by means of screws 12 of the type described and illustrated in the Boysen patent. The bushing is received in a circular opening in the panel 9 and is threaded to receive a mounting ring 13 seated against a legend plate 14. It is also usual to supply sealing and cushioning washers 15 between the base of the bushing 10 and the panel 9. A hollow, tubular actuator 16 is received in the bore of the bushing 10 and has attached to its outer end a threaded, mushroom head operator 17. The operator 17 is translucent and may be clear or colored. Extending from the open end of the base member 11 is a socket 18 for receiving a lamp, as will later be described. Also extending from the base member 11 through apertures 20 are two switching members **19*a* and 19*b*. As shown herein, the switching member 19*b* is shortened at its outer end to accommodate a transformer module (not shown) when lamps of reduced voltage are used. However, in all other aspects, the members 19*a* and 19*b*** are substantially identical.

It will be observed from the remaining views that the switch operating assembly is comprised of concentrically arranged components each being tubular in nature or otherwise providing means for accommodating a lamp 21 and its socket 18. The lamp may be of the conventional bayonet type and the socket 18 includes terminals 22 engageable with connectors on a terminal module or transformer module, not herein shown. This arrangement, not only permits installation of the lamp and socket assembly, but further alternatively permits either manual axial push-pull, or rotational operation of the actuator 16, the latter resulting in a "twist-to-release" function for operating the pushbutton from the depressed position of FIG. 4 to the normal, extended position shown in FIG. 3, as will be hereinafter described.

Figure 5:
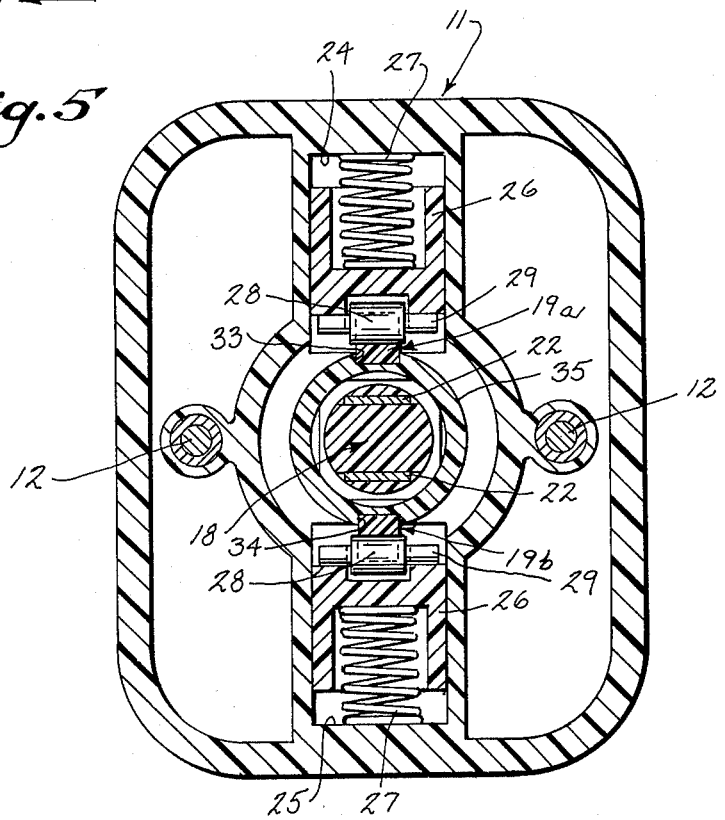
FIG. 5 is a cross sectional view taken along lines 5—5 of FIG. 3.

In general, it will be noted that the base member 11 includes laterally extending, oppositely disposed cavities 34 and 25 which respectively receive cup-like detent members 26. Each of the detent members 26 is adapted to receive respective compression springs 27 bearing at one end against the inside surface of the cavity of each of the cup-like detent members 26 and at the opposite ends thereof against the inner wall of the respective cavities 24, 25. The free ends of the detent members 26 are arranged to receive and support rollers 28 suspended between oppositely extending pins 29 (see FIG. 5).

Figure 4:
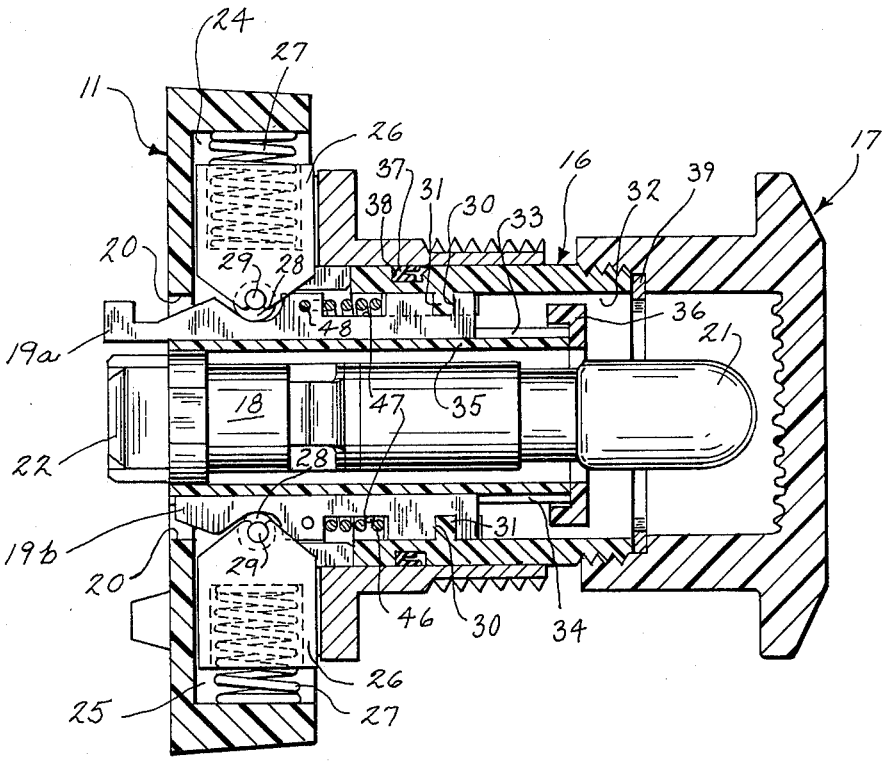
FIG. 4 is a longitudinal sectional view, similar to FIG. 3, but with the actuator of the assembly being in depressed operating position relative to the supporting base.
Figure 3:
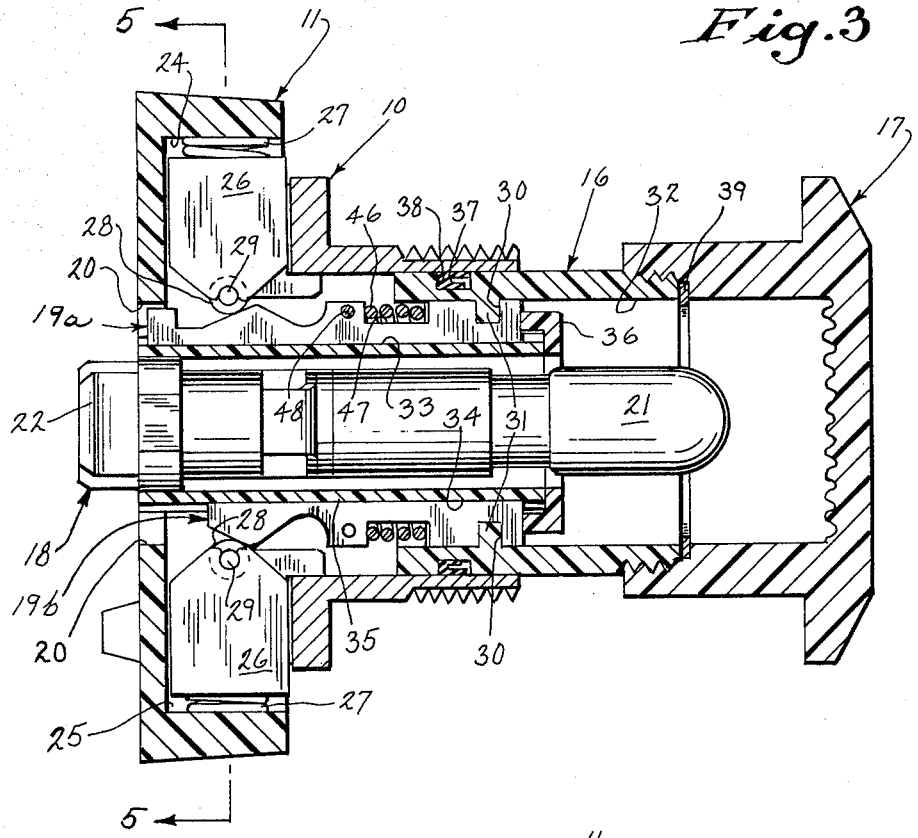
FIG. 3 is a longitudinal section of the assembly of FIG. 1, and with the several component parts in normal operating position with the pushbutton actuator extended relative to its supporting base.

FIG. 3 is illustrative of the switch operator assembly with the operating parts disposed in the normally extended position, whereas FIG. 4 illustrates the same components positioned in the depressed button position relative to the supporting base member 11. It will be observed from FIG. 3 that the rollers 28 on the respective detent members 26 are at rest on the "fall" portion of the "dwell-rise-fall-dwell" cam profile of the oppositely disposed, axially slidable, switching members 19*a* and 19*b*. Each of the detent members 26 is illustrated in FIG. 3 in the spring-biased position with the rollers 28 resting in the "fall" position relative to the cam profile. The compression springs 27 are shown in their compressed position to effect this relationship. There is also a spring-bias exerted against the switching members 19*a* and 19*b* is an axial direction towards the normal operating position of FIG. 3, emanating from return springs of the contact block modules (not shown). This biasing action is further described in the aforementioned U.S. Pat. No.

3,514,554.

It will be observed that the switching members 19*a* and 19*b* are each provided with notches 30 in supporting and rotationally sliding engagement with inwardly disposed ledge portions 31 integrally formed in the tubular bore 32 of actuator 16. Thus, the switching members 19*a* and 19*b* will be moved in an axial direction concurrently with "push-pull" axial movement of the actuator 16. The opposite sides of each of the switching members 19*a* and 19*b* are slidably supported in oppositely disposed grooves 33 and 34 formed in the upstanding, hollow post 35 integrally formed with the base 11. This hollow post is further adapted to receive the lamp 21 and its socket 18. A cap 36 is sonically welded to the end of the post 35 and acts as a forward stop means upon engagement with the actuator 16.

It will be noted that manual depression of the mushroom head operator 17, which is in threading engagement with the actuator 16, causes the actuator 16, along with the switching elements 19*a* and 19*b*, to be moved to the depressed position shown in FIG. 4. The various components located interiorly of the assembly are sealed from the atmosphere by means of the compressible annular gasket 37 seated in the groove 38 and the lens gasket 39.

It will be observed from FIG. 4 that the rollers 28 of the detent members 26 will be caused to move from the "fall" portion of the cam profile on the switching elements 19*a* and 19*b* to the second "dwell" position shown in FIG. 4. The profile thus presents a rest position for the depression spring 27 in its distended position.

Thus, manual "push-pull" operation of the pushbutton assembly, which operation is particularly useful with "emergency stop" type of buttons, has been preserved by the present construction. This construction additionally accommodates the desirable illuminated signal means, provided by the lamp 21 and its socket 18.

Figure 6:
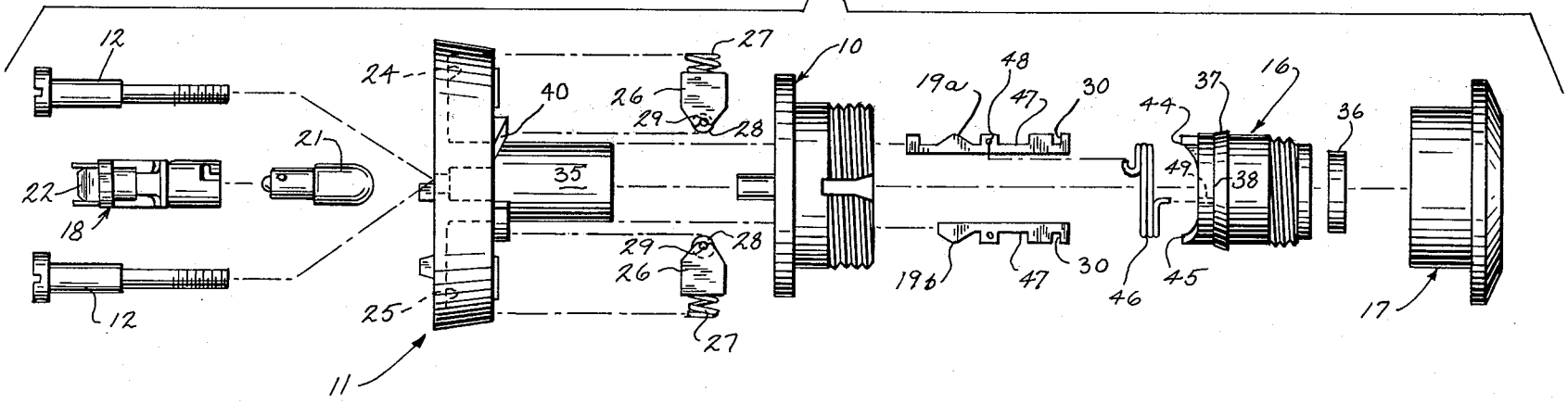
FIG. 6 is an exploded elevational view, illustrating the various operating components in their unassembled relationship relative to one another.
Figure 7:
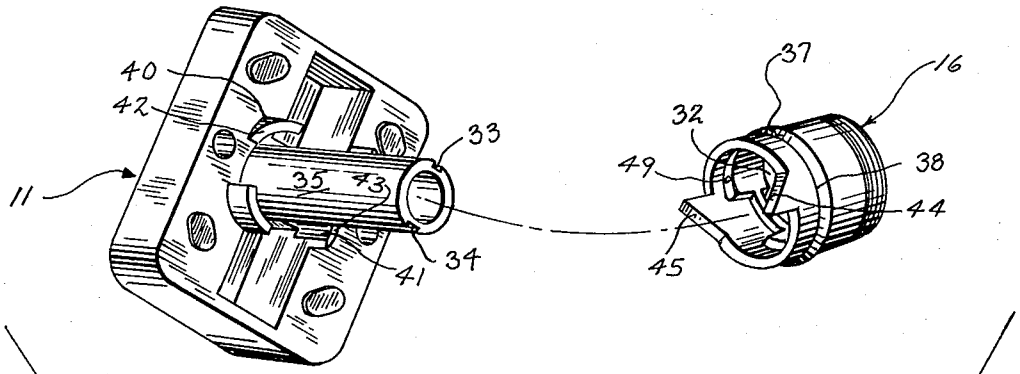
FIG. 7 is a perspective exploded view indicating the operational relationship between two functioning components.

As stated previously, the present invention further provides a "twist-to-release" function through the switch operator assembly. This function was heretofore difficult to obtain in the case of illuminated pushbuttons because of interference of spring-biasing components. In addition, this added function provides release means acceptable to certain markets foreign to the United States, where it is conventional to manually twist a stop button to return the same to normal operating position. This "twist-to-release" feature is attained by means of an integrally formed camming profile on the upstanding portions 40 and 41 disposed oppositely of one another on the base member 11. The portions 40 and 41 define ramp surfaces 42 and 43, respectively. The ramp surfaces 42 and 43 are arranged to slidably mate with corresponding ramp surfaces 44 and 45 located at the inner end portion of the actuator 16 (see FIGS. 6 and 7). A torsion spring 46 surrounds the post 35 of the base 11 and is received in the elongated notches 47 of switching members 19*a* and 19*b*. One end of the spring 46 is seated in an aperture 48 of the switching member 19*a*, and retained at its opposite upturned end seated in a reentrant hole 49 of the actuator 16. It will thus be apparent that manual twisting or rotation of the mushroom head 17 and the actuator 16 threaded thereon will cause the ramp surfaces 44 and 45 on the actuator 16 to act against the respective mating ramp surfaces 42 and 43 to impart an axial movement to the actuator 16 in a direction away from the base 11, and thus concurrently withdraw switching elements 19*a* and 19*b* to the position shown at FIG. 3 against the spring bias of the springs 27 and the detents 26.

The embodiments of the invention of which an exclusive property or privilege is claimed are defined as follows:

1. A pushbutton switch operator assembly comprising:

a supporting, apertured base slidably receiving an axially movable switching member having a longitudinal cam profile, said cam profile defining first and second longitudinal operating switch positions;

spring-biased detent means engageable with said cam profile for alternatively maintaining said switching member in one of said first and second switch operating positions;

a manually operable actuator adapted for axial and rotatable movement relative to said base, and arranged to retain and rotatably receive said switch member;

cam means between said base and said actuator for providing axial movement to said actuator concurrently with manual rotation of the actuator;

whereby said actuator may be manually moved axially in a direction away from said base either by rotative operation under the action of said cam means, or alternatively, by a manual pulling action on said actuator to thereby, in either case, cause said retained switch member to move longitudinally against the biasing action of said detent member.

2. The pushbutton switch operator assembly of claim 1, wherein said actuator is tubular and rotatively supported on a hollow post member integral with and extending from said base; wherein a lamp and lamp socket are removably retained in the bore of said hollow post; and wherein a translucent operator is provided as a closure member for one end of said tubular actuator.

3. The pushbutton switch assembly of claim 1 wherein said spring-biased detent means comprises a detent member slidably supported in a cavity in said base extending radially relative to the longitudinal axis of said actuator and compression spring in said cavity biasing said detent member toward the cam profile of said switching member.

4. The pushbutton switch operator assembly of claim 3, wherein the cam profile of said switching member defines a dwell-rise-fall-dwell camming surface.

5. The pushbutton assembly of claim 3, wherein there is provided a pair of peripherally spaced switching members and spring-biased detent members in diametrically opposed relationship relative to the longitudinal axis of said actuator.

6. The pushbutton switch operator assembly of claim 1, wherein said actuator is tubular and said base includes an inwardly extending post member relatively supporting said actuator, said post member includes a longitudinal groove substantially coextensive of its length and said switching member is slidably received in said longitudinal groove.

7. A pushbutton switch operator assembly comprising:

a supporting member including a base portion defining a laterally extending cavity slidably carrying a spring-biased detent member and an aperture in the bottom surface of said groove, an integral, upstanding post extending from said base portion and including a longitudinal groove substantially coextensive of its length and communicating at one end with said aperture, and an integral upstanding cam portion having a rise-return ramp profile;

a reciprocating linear, notched switching member slidably seated in the longitudinal groove of said post and having a switch operating portion extending through said aperture, said switching member including a longitudinal cam surface engageable with the spring-biased detent member and defining a dwell-rise-fall-dwell cam profile;

and a tubular actuator member rotatably and slidably received by the upstanding post of said supporting member and defining an inwardly extending ledge slidably received by the notch of said switching member, said actuator having its innermost end formed to provide a rise-return ramp profile rotatably engageable with the rise-return ramp profile formed in upstanding cam portion of said supporting member;

and torsion spring means for biasing said actuator towards cam return position;

whereby said actuator may be manually moved axially in a direction away from said base member either by rotative operation under the action of said mating ramp surfaces, or alternatively, by a manual pulling action on said actuator to thereby, in either case, cause said switch member to move longitudinally against the action of said detent member.

8. The pushbutton switch operator assembly of claim 7, wherein said upstanding post is hollow and arranged to receive an illuminating lamp and a lamp socket within the bore of said hollow post, and a translucent mushroom head operator threadingly engaging said actuator.

* * * * *

UNITED STATES PATENT AND TRADEMARK OFFICE

CERTIFICATE OF CORRECTION

PATENT NO. : 4,404,445

DATED : September 13, 1983

INVENTOR(S) : Michael S. Baran et al

It is certified that error appears in the above-identified patent and that said Letters Patent are hereby corrected as shown below:

Column 3, Line 13 - "34" should be --24--

Column 3, Line 39 - "is" should be --in--

Column 5, Line 29 - "relatively" should be --rotatively--

Signed and Sealed this

*Fifteenth* Day of *May 1984*

[SEAL]

*Attest:*

GERALD J. MOSSINGHOFF

*Attesting Officer*

*Commissioner of Patents and Trademarks*